US005401015A

United States Patent [19]

Woodall

[11] Patent Number: 5,401,015

[45] Date of Patent: Mar. 28, 1995

[54] ADJUSTABLE BASKETBALL GOAL

[76] Inventor: Bliss T. Woodall, 229 Cottage Pl., Nashville, Tenn. 37214

[21] Appl. No.: 92,224

[22] Filed: Jul. 15, 1993

[51] Int. Cl.[6] ..... A63B 63/08

[52] U.S. Cl. ..... 273/15 R

[58] Field of Search ..... 273/1.5 R, 1.5 A, 369, 273/370

[56] References Cited

U.S. PATENT DOCUMENTS

| | | | |
|---|---|---|---|
| 3,477,714 | 11/1969 | Garlington | 273/1.5 R |
| 4,202,543 | 5/1980 | Collins | 273/1.5 R |
| 4,218,058 | 8/1980 | Hilbert et al. | 273/1.5 |
| 4,239,214 | 12/1980 | Brenner | 273/1.5 |
| 4,496,160 | 1/1985 | Wichinsky et al. | 273/369 |
| 4,643,422 | 2/1987 | Cramblett | 273/1.5 |
| 4,738,448 | 4/1988 | Liester | 273/1.5 R |
| 4,781,375 | 11/1988 | Nye | 273/1.5 |
| 4,838,549 | 6/1989 | Woodall | 273/1.5 |
| 5,035,423 | 7/1991 | Arciniega | 273/1.5 A |
| 5,071,120 | 12/1991 | Dadbeh | 273/1.5 R |

FOREIGN PATENT DOCUMENTS

| | | | |
|---|---|---|---|
| 1459675 | 2/1989 | U.S.S.R. | 273/1.5 R |

*Primary Examiner*—Paul E. Shapiro

[57] ABSTRACT

The present invention discloses an adjustable goal for placement on a support. A sleeve is attached to the support. A block is mounted within the sleeve and a worm gear drives the block along the length of the sleeve. A bracket fits over the sleeve and is attached to the block through a slot in the back side of the sleeve. The goal is attached to the bracket to allow the goal to move along the sleeve with the movement of the block. Rotational movement of the goal and backboard in relationship to the support is provided by an additional set of gears. This allows the user to simulate shots from all angles at the goal.

14 Claims, 4 Drawing Sheets

ADJUSTABLE BASKETBALL GOAL

Be it known that I, Bliss T. Woodall, a citizen of the United States, residing at 229 Cottage Place, Nashville, Tenn. 37214, have invented a new and useful "*Adjustable Basketball Goal*".

BACKGROUND OF THE INVENTION

The present invention relates generally to an adjustable basketball goal and more particularly to a basketball goal that can be moved rotationally as well as from side to side to allow an individual to simulate shots from all angles to the goal, even where there is limited playing area.

It will be appreciated by those skilled in the art that many individuals practice their basketball shooting on goals located on driveways or on some other limited space. It will further be appreciated by those skilled in the art that in such limited spaces such as driveways, shots to the goal from the comer or base line shots are very limited in that the width of the driveway or other constrained space limits the distance of the base line shot. It will further be appreciated by those skilled in the art that a shot from the right base line is much different than a shot from the left base line. As a result, the user must practice shots from both sides of the goal. This cannot be performed in constrained spaces. To this end, there have been several attempts to improve basketball goals.

U.S. Pat. No. 4,838,549 discloses a basketball retriever device issued Jun. 13, 1989, to the present applicant. Although this invention did provide a basketball retriever device, it only allowed front on shots such as that from the free throw line and allowed the ball to be returned to the user. No baseline shots were possible.

U.S. Pat. No. 4,218,058 issued to R. Hilbert et at. on Aug. 19, 1990, discloses an adjustable system for mounting a basketball goal which is vertically adjustable. However, no disclosure is made as to rotation of the goal.

U.S. Pat. No. 3,477,714 issued to W. Garlington on Nov. 11, 1969, discloses a goal which is moved laterally in relationship to the backboard. Unfortunately, the backboard is not moved. Further, the slot through which the basketball goal comes is susceptible to being hit by a ball. As a result, the gear is susceptible to wear and tear.

U.S. Pat. No. 4,239,214 issued to R. Brenner on Dec. 16, 1980, discloses a device which provides a backboard which can be bent in various directions to provide trick shots. Unfortunately, neither the backboard nor the goal are moved laterally to take advantage of a confined area.

U.S. Pat. No. 4,781,375 issued to S. Nye on Nov. 1, 1988, discloses an up and down movement of the goal and the backboard. However, neither lateral nor rotational movement is disclosed.

U.S. Pat. No. 4,239,214 issued to R. Brenner on Dec. 16, 1982, discloses another goal which can be moved in different positions in relationship to the backboard and allows curvature of the backboard to provide trick shots. However, neither lateral movement of the goal in relationship to the support nor rotational movement of the goal in relationship to the support is disclosed.

U.S. Pat. No. 4,643,422 issued to J. Cramblett on Feb. 17, 1987, discloses a vertically adjustable basketball goal. Unfortunately, neither rotation or lateral movement is provided.

What is needed, then, is a basketball goal which can be moved laterally as well as rotationally to simulate shots from different angles with the goal post and the shooter remaining at the same spot of the playing area. Preferrably, this goal will be capable of withstanding the elements so that it can be used outside. In such cases, this goal should not have the lateral mechanical movement device exposed to the elements. This device must be simple to use. The desired device should also be adaptable for inside use. Electrical motors and remote control devices are optional for use in driving the gears that operate the basketball goal of the present invention. Such a device is presently lacking in the prior art.

SUMMARY OF THE INVENTION

The present application discloses an adjustable goal for placement on a support. In the preferred embodiment, a sleeve is attached to the support. The sleeve, in combination with a worm drive passing through a block within the sleeve, allows the goal to be moved laterally along the sleeve when the worm drive is turned by the use of a combination of driving and driven gears. Whether the sleeve is or is not used, rotational movement of the goal and backboard is provided by an additional set of gears. This allows the user to simulate shots from all angles at the goal.

Accordingly, one object of the present invention is to provide an adjustable basketball goal which can be moved from side to side.

Still another object of the present invention is to provide an adjustable basketball goal that can be rotationally moved to allow one to simulate shots from various angles.

A still further object of the present invention is to provide a lateral movement device which is not exposed to the elements.

Still another object of the present invention is to provide a lateral and rotational system which can be easily used.

U.S. Pat. No. 4,838,549 discloses a basketball retriever device issued Jun. 13, 1989, to the present applicant. It is a therefore a further object of the present invention to provide a device that can be used in connection with the stand and nets provided in U.S. Pat. No. 4,838,549.

DESCRIPTION OF THE PREFERRED EMBODIMENT

Figure 1:
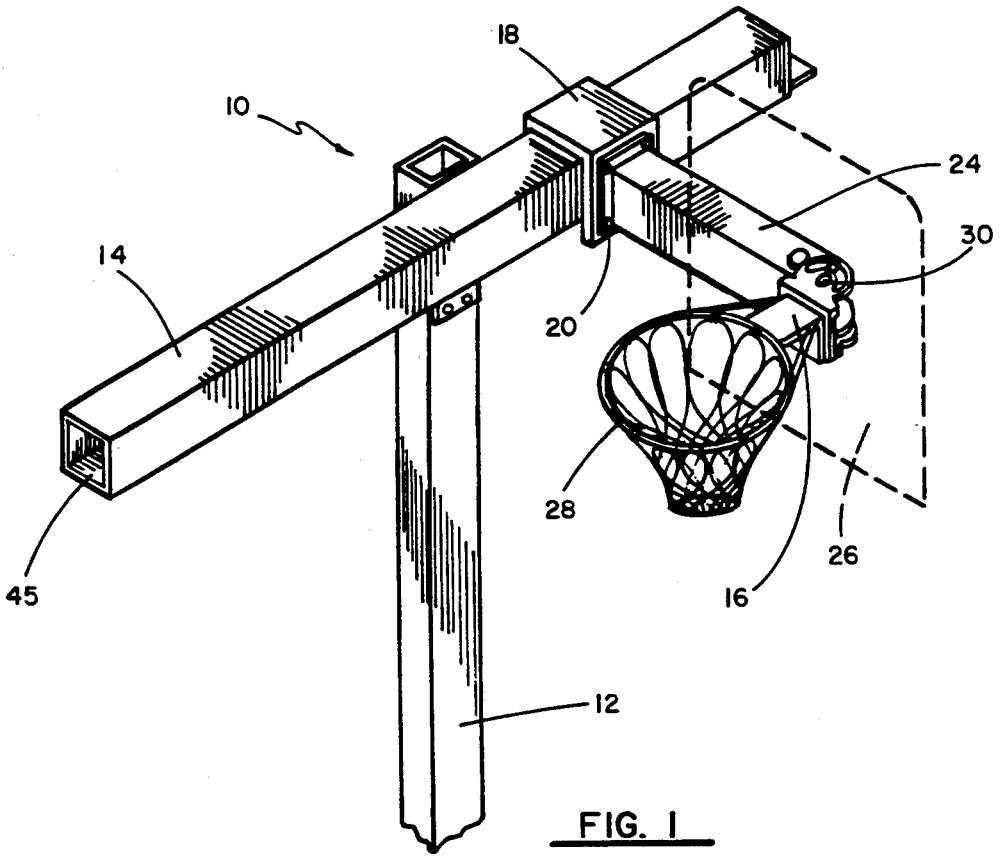
FIG. 1 is perspective view of the "Adjustable Basketball Goal" of the present invention.

Referring now to FIG. 1 there is shown generally at 10 the adjustable basketball goal device of the present invention. Device 10 is attached to standard support 12, which can be a vertical pole, can be a slightly curved, or can be any other support presently used or usable for a basketball goal support. In this particular embodiment, sleeve 14 is attached to support 12 by the use of an angle iron 11. Angle Iron 11 has a leg 13 and an arm 15 which are perpendicularly joined to form a shelf on which the sleeve 14 sits. The device is provided with "U" bolts 17 which pass around support 12 and through holes in leg 13 of angle iron 11. Nuts threadedly engaged to the ends of the "U" bolts 17 secure the angle iron 11 to the support 12. Sleeve 14 is fixed in any well known manner such as by welding, clamping, and the like to the arm 15 of angle iron 11. By mounting the device 10 to the support 12 in this manner, the bracket 18 is spaced from the support 12 and as the bracket 18 traverses along the sleeve 14, in the manner hereinafter described and which can be seen in FIGS. 1 and 3, the bracket 18 clears the support 12 so that its movement is uninterrupted.

Figure 3:
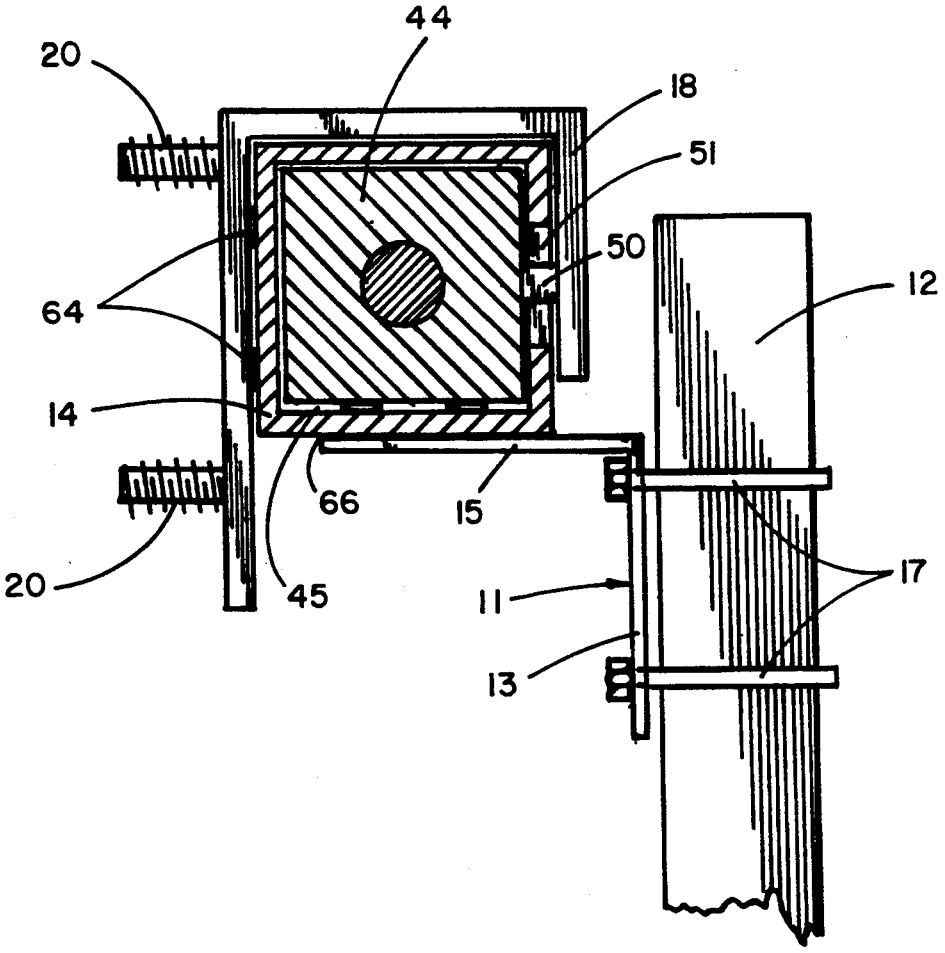
FIG. 3 is a cutaway, side view of the lateral movement device of the present invention.
Figure 5:
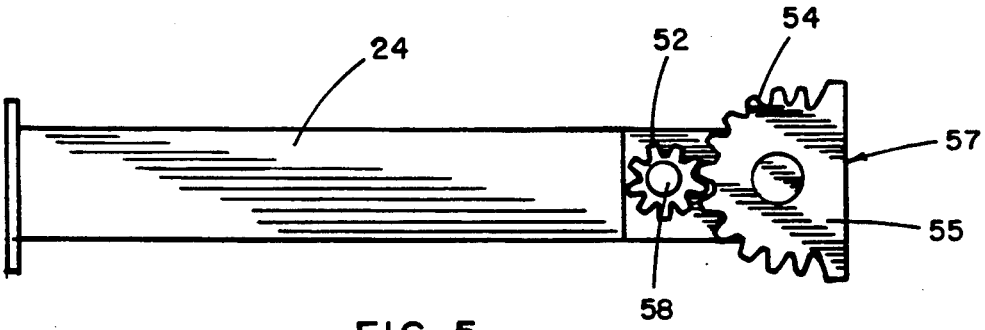
FIG. 5 is a top view of the rotational movement device of the present invention.

As can be seen from FIGS. 1 and 3, bracket 18 fits over sleeve 14 and is designed to traverse along the length of sleeve 14 from one end to the other. Extension arm 24 is an elongated brace attached at one end to the bracket 18. Goal 16 is pivotally attached to the other end of extension arm 24. Goal 16 includes backboard 26 and rim 28 in the usual fashion. The pivotal attachment between extension arm 24 and goal 16 is achieved through pin 30 as will be more specifically described in reference to FIGS. 5, 6 and 7.

Figure 2:
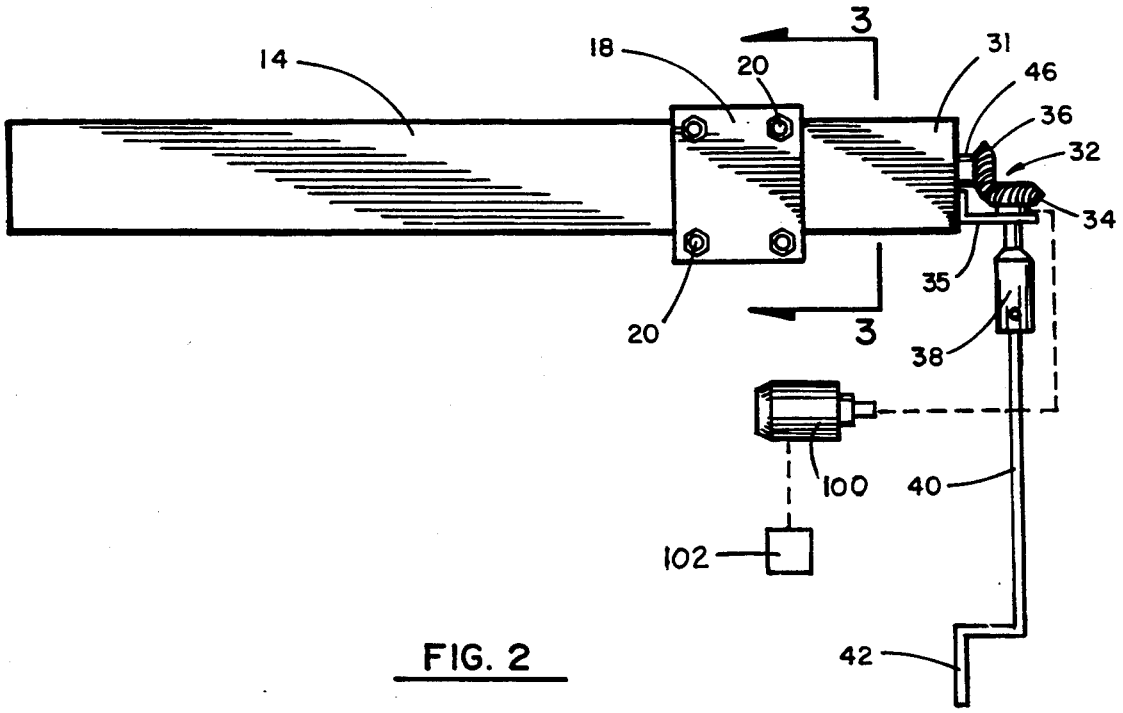
FIG. 2 is a frontal view of the lateral movement device of the present invention.

Referring now to FIG. 2 them is shown generally at 14 the sleeve of the present invention. As is discussed above, sleeve 14 is encircled by bracket 18 which traverses along sleeve 14. At one end 31 of sleeve 14 there is a gear drive mechanism 32. At sleeve end 31, gear mechanism includes drive gear 34 which is in geared connection with driven gear 36. Drive gear 34 is rotatably mounted to support plate 35 which plate is, in turn, fixed to the end of the sleeve 14. Crank adaptor 38 is attached to drive gear 34 such that rotation of the crank adaptor 38 also rotates drive gear 34. Crank tool 40, having a crank handle 42, is provided to releasably engage crank adaptor 38 so that, when engaged and rotated, crank tool 40 will rotate adaptor 38. Rotation of drive gear 34, in turn, rotates driven gear 36.

Alternatively, drive gear 34 may be driven by electric motor 100 as is schematically illustrated in FIG. 2. The operation of motor 100 may be controlled by remote control device 102.

Figure 4:
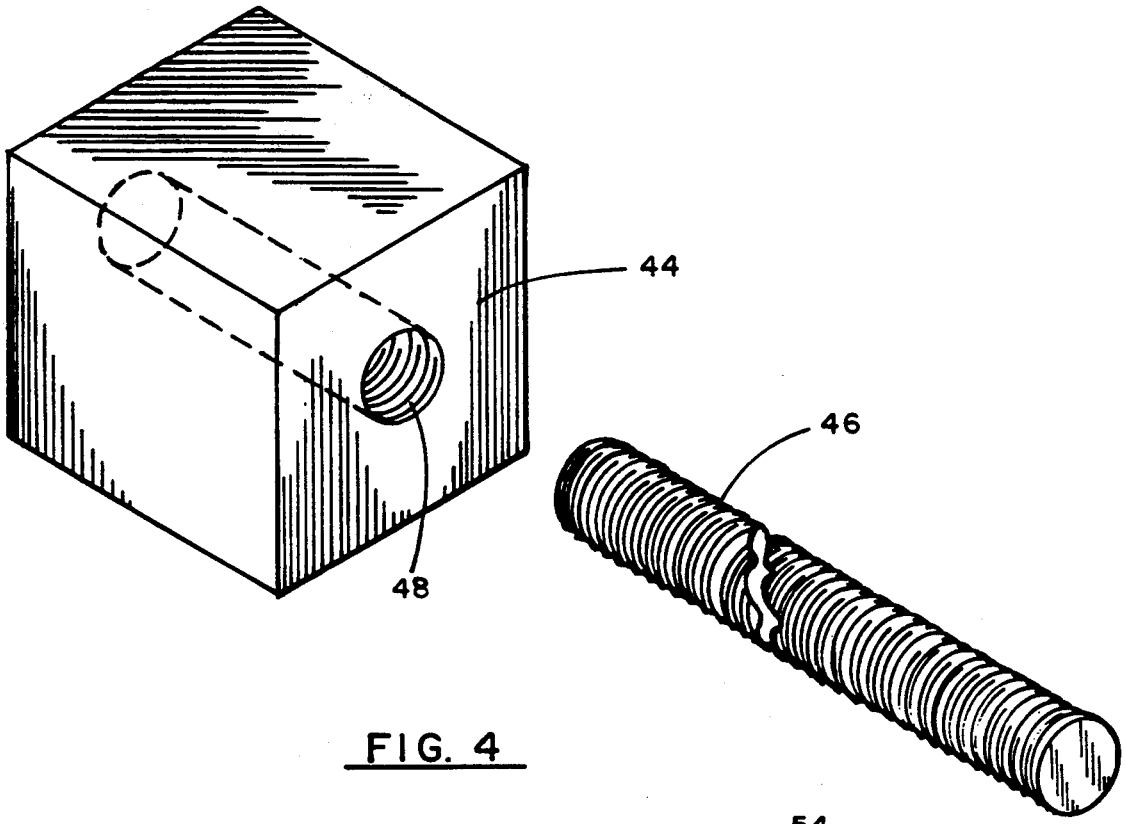
FIG. 4 is a perspective view of the lateral movement device of the present invention.

Referring now to FIGS. 3 and 4 together, there is shown more particularly the lateral movement device of the present invention. As can be seen in FIGS. 3 and 4, block 44 is located within the cavity 45 of sleeve 14, and is fitted to slides along the length of said cavity. Threaded rod 46 is the length of sleeve 14 and is positioned within the cavity 45. Block 44 has threaded orifice 48 which receives threaded rod 46 to form a worm gear drive. Thus, as threaded rod 46 is rotated, block 44 moves along sleeve 14. Bracket 18 is attached to block 44 by spacer plate 50 which passes through slot 51 formed in the backside of sleeve 14. Thus, movement of block 44 along sleeve 14 also moves bracket 18 along sleeve 14. Therefore, as can be seen in FIGS. 2–4, as handle 42 of crank tool 40 is rotated, crank adaptor 38 is also rotated thereby rotating drive gear 34. Drive gear 34 in turn rotates driven gear 36 which turns threaded rod 46, driven gear 36 being fixedly attached to the end of threaded rod 46. Rotation of threaded rod 46, in turn, through the worm gear mechanisn moves block 44 traversely along the cavity 45 of sleeve 14. FIG. 3 also shows bolts 20 which are used to attach extension arm 24 to bracket 18.

Figure 6:
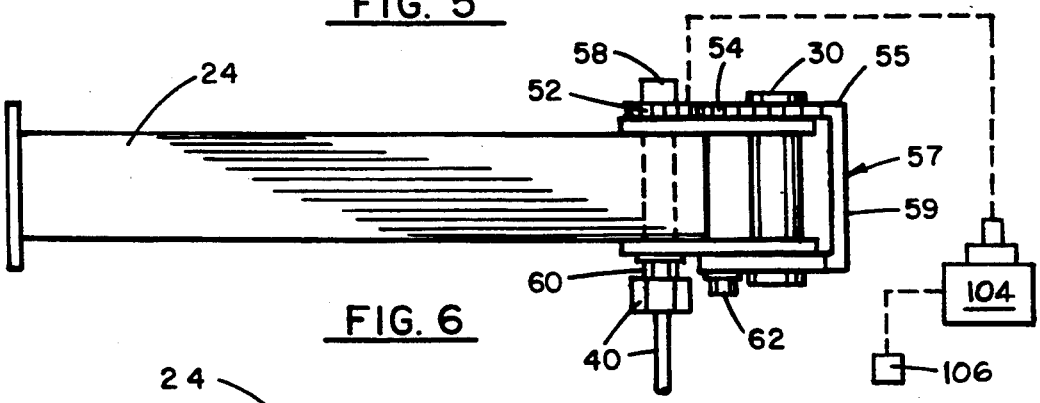
FIG. 6 is a side view of the rotational movement device of the present invention.
Figure 7:
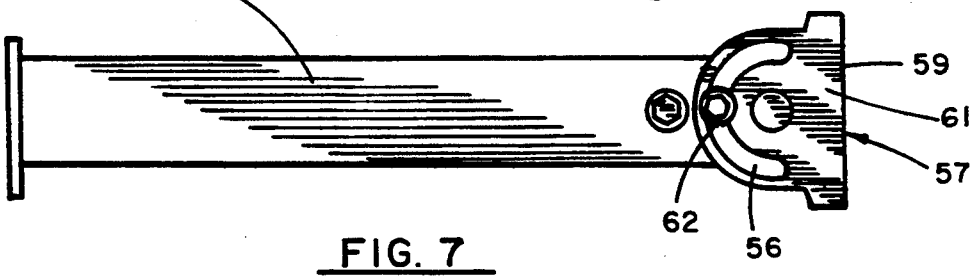
FIG. 7 is a plan view of the bottom of the rotational movement device of the present invention.

Referring now to FIGS. 4–8, there is shown generally at 24 the extension arm of the present invention. As can be seen from these figures, a second drive gear 52 is mounted to shaft 58 which passes through and freely rotates in an opening passing through extension arm 24. Second driven gear 54 is in geared contact with second drive gear 52 so that rotation of gear 52 drives gear 54. Attached to shaft 58 is second adaptor 60 to which tool 40 can be engaged to rotate drive gear 52. Rotation of tool 40, rotates adaptor 60, which rotates shaft 58, which rotates gear 52. The rotation of gear 52 may be by operation of electric motor 104 as is schematically illustrated in FIG. 6. The operation of electric motor 104 may be controlled by remote control device 106.

Second driven gear 54 is formed in the top leg 55 of "U" shaped connector 57 which has a face 59 and a bottom leg 61. Holes are formed in top leg 55 and bottom leg 61 and are designed to align with a hole formed in the end of extension arm 24. Pin 30 passes through extension arm 24 and the holes in the legs of connector 57 to pivotially connect the connector 57 to the extension arm 24. Attached to the face 59 of the connector 57 is goal 16. Thus, second driven gear 54 is rotatably attached to pin 30 so that rotation of gear 54 rotates connector 57. Likewise, goal 16 is fixed to the face 59 of connector 57 such that rotation of second driven gear 54 rotates goal 16 about pin 30. To insure that goal 16 can be fixed in a desired position after being rotated to that position, track 56 is provided in bottom leg 61 and guides the movement of connector 57 through the arc of track 56 with locking bolt 62 riding in the track 56. The relationship can be locked in place by tightening bolt 62 with tool 40.

As can be seen in FIG. 3, in the preferred embodiment, bearings 64 are provided between bracket 18 and sleeve 14 to provide ease of movement between those two elements. Further, a second set of bearings 66 can be placed in block 44 to facilitate movement of block 44 in relation to sleeve 14.

Figure 8:
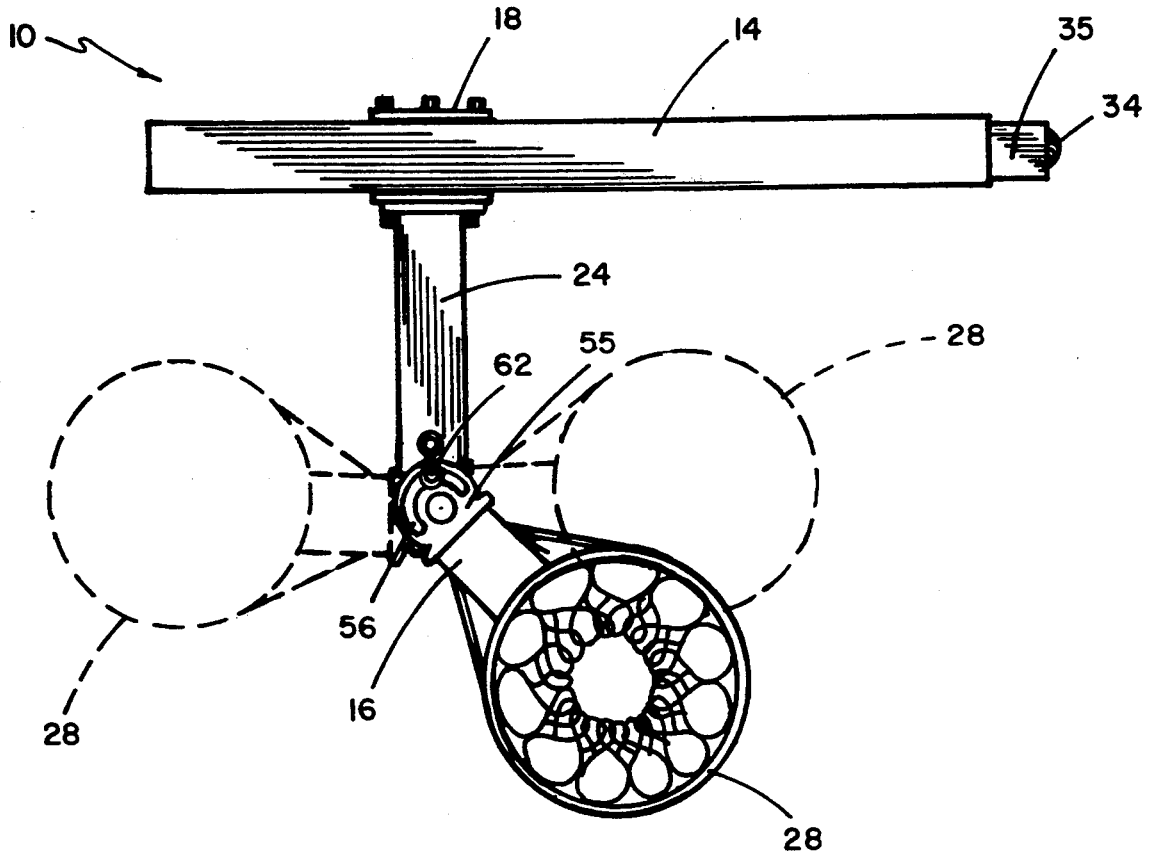
FIG. 8 is plan view from beneath the "Adjustable Basketball Goal" of the present invention.

Referring to FIG. 8, the operation of the goal of the present invention can be seen. The phantom lines of the rim 28 shows the rim in the alternate positions of being to the left or the right of the extension arm 24. The rim 28 can be located in any relative position through a 180 degree arc by the rotation of the second drive gear 52. Similarly, the position of the backboard 26 and the goal 28 along the length of the sleeve 14 can be achieved by rotation of the drive gear 32 through the drive train previously described.

Thus, although there have been described particular embodiments of the present invention of a new and useful adjustable basketball goal, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for adjustably mounting a basketball backboard and goal to a stationary support, including a playing surface, a stationary support and a basketball backboard and goal, the improvement including:

a. a substantially horizontal sleeve positioned approximately 10 feet above the playing surface;

b. first means attaching said sleeve to said support in a fixed relationship;

c. an elongated arm having a first end and a second end and means for slidably attaching said arm at its first end to said sleeve; and d. means for rotatably attaching said goal to said arm at its second end.

2. The device of claim 1 wherein said means for attaching said sleeve to said support comprise an angle iron and at least one U-bolt.

3. The device of claim 1 wherein said means for slidably attaching said arm at its first end to said sleeve comprise a bracket which slides along said sleeve.

4. The device of claim 3 wherein said means for slidably attaching said arm at its first end to said sleeve comprise:

a. said sleeve having a cavity;

b. a threaded rod having a first and a second end, said threaded rod placed within the cavity of said sleeve;

c. a drive gear mounted on said sleeve;

d. a driven gear attached to said first end of said threaded rod such that turning said driven gear rotates said threaded rod;

e. said driven gear in geared connection with said drive gear;

f. means for turning said drive gear;

g. a block slidably mounted within the cavity of said sleeve, said block having a threaded orifice to receive said threaded rod such that turning said threaded rod moves said block along said sleeve; and h. means for attaching said bracket to said block.

5. The adjustable goal of claim 1 wherein said means for rotatably attaching said goal to said arm at its second end comprise a drive gear mounted on said arm and a driven gear connected thereto to which said goal is attached such that driving said drive gear rotates said goal.

6. A device for adjustably mounting a basketball goal on a pole including a stationary pole and a goal, the improvement comprising:

a. means for mounting said goal spaced from said pole whereby said goal can slide traversely relative to said pole; and b. means for mounting said goal so that said goal can rotate about a point in spaced relation to said pole.

7. The adjustable goal of claim 6 wherein said means for mounting said goal so that it can rotate about a point in spaced relation to said pole comprises:

a. a gear in spaced relation to said pole;

b. another gear mounted on said goal such that rotating said other gear rotates said goal, said other gear in geared attachment to the first gear; and c. means for rotating the first gear.

8. A device for adjustable mounting a basketball goal on a support including a basketball goal and a support, the improvements comprising:

a. a substantially horizontal sleeve having an inner track;

b. means for attaching said sleeve to said support;

c. a bracket slidably attaching said goal to said sleeve;

d. a threaded rod placeable inside said sleeve having a first and a second end;

e. a first gear mounted on said sleeve;

f. a second gear attached to said first end of said threaded rod such that turning said second gear rotates said elongated rod, said second gear gearedly attached to said first gear;

g. means for turning said first gear;

h. a block slidably receivable by said track, said block having a threaded orifice to receive said threaded rod such that turning said threaded rod moves said block along said sleeve;

i. means for attaching said block to said bracket;

j. a third gear mounted on said bracket;

k. a fourth gear mounted on said goal such that rotating said fourth gear rotates said goal, said fourth gear in geared attachment to said third gear; and l. means for rotating said third gear.

9. The device as claimed in claim 8 wherein the means for rotating said first gear is an electric motor.

10. The device as claimed in claim 9 wherein the means for rotating said third gear is an electric motor.

11. The device as claimed in claim 10 including remote control device means to control the operation of the said electric motor.

12. The device as claimed in claim 9 including remote control device means to control the operation of the said electric motor.

13. The device as claimed in claim 8 wherein the means for rotating said third gear is an electric motor.

14. The device as claimed in claim 12 including remote control device means to control the operation of the said electric motor.

* * * * *